US006647752B1

(12) United States Patent
Chaillie

(10) Patent No.: US 6,647,752 B1
(45) Date of Patent: Nov. 18, 2003

(54) ELECTRONIC KEY FOR MOTOR VEHICLE

(75) Inventor: Frederic Chaillie, Pechbonnieu (FR)

(73) Assignee: Siemens VDO Automotive, Toulouse (FR)

( * ) Notice: Subject to any disclaimer, the term of this patent is extended or adjusted under 35 U.S.C. 154(b) by 0 days.

(21) Appl. No.: 09/979,844

(22) PCT Filed: May 17, 2000

(86) PCT No.: PCT/EP00/04482

§ 371 (c)(1),
(2), (4) Date: Nov. 28, 2001

(87) PCT Pub. No.: WO00/73606

PCT Pub. Date: Dec. 7, 2000

(30) Foreign Application Priority Data

May 28, 1999 (FR) ..... 99 06791

(51) Int. Cl.[7] ..... E05B 19/04; E05B 19/10

(52) U.S. Cl. ..... 70/456 R; 70/408; 70/459; 70/460; 70/257

(58) Field of Search ..... 70/408, 456 R, 70/459, 460, 278, 413, 257, 277, 278.2, 278.3, 283, 283.1, 252, 256, 278.1, 279.1

(56) References Cited

U.S. PATENT DOCUMENTS 3,349,589 A * 10/1967 Fricke ..... 70/395
3,427,834 A * 2/1969 Tutino ..... 70/414
3,605,464 A * 9/1971 Ostrager ..... 70/414
4,354,368 A * 10/1982 Toyoda ..... 70/456 R
4,524,594 A * 6/1985 Bascou ..... 70/456 R
4,941,569 A 7/1990 Lindmayer et al.
5,117,666 A * 6/1992 Keefer ..... 70/456 R
5,355,702 A * 10/1994 Escribens ..... 70/395
6,216,501 B1 * 4/2001 Marquardt et al. ..... 70/252

FOREIGN PATENT DOCUMENTS

| | | |
|---|---|---|
| DE | 44 44 913 A1 | 6/1995 |
| DE | 297 22 484 | 2/1998 |
| WO | WO 98/03949 | 1/1998 |

* cited by examiner

*Primary Examiner*—Anthony Knight
*Assistant Examiner*—Michael J. Kyle
(74) *Attorney, Agent, or Firm*—Young & Thompson

(57) ABSTRACT

The present invention relates to an electronic key (10) for an automotive vehicle, said key being of generally flat parallelepipedal shape and comprising:

a housing (12) for an electronic card, said card being adapted to control electronically a locking/unlocking device onboard the vehicle and permitting the locking/unlocking of the openings of the vehicle, and an insert compartment (11) housing an emergency insert adapted to lock/unlock mechanically the openings of a vehicle in case of malfunction of the electronic card, said electronic key being characterized in that the insert (13) is constituted solely of a key blade and is provided with recesses (16) adapted to coact with retaining means (15) provided in the insert compartment to hold firmly the insert in the compartment no matter what its position.

7 Claims, 1 Drawing Sheet

ELECTRONIC KEY FOR MOTOR VEHICLE

BACKGROUND OF THE INVENTION

The present invention relates to an electronic key for an automotive vehicle. More particularly, it relates to an intelligent key, called a "smart key" that does not require a blade to control the locking/unlocking of the openings of a vehicle.

SUMMARY OF THE INVENTION

The doors of a vehicle are constituted by all the movable portions permitting access to the interior of the vehicle or beneath its hood. Thus, it can as well relate to the doors of a vehicle, the trunk, the convertible top, the hood, the windows etc., . . .

It is already known to provide a vehicle with a remote control device for its openings. This can be devices (electronic key) emitting infrared or waves of any other nature to give a remote opening or closing order.

Such electronic keys require no coaction between a blade and a lock to operate. The vehicle could even be free from any mechanical lock. However, for reasons of certainty of operation, it is necessary to provide a mechanical access means to be used in the case in which the electronic key fails to function.

To this end, it is known to provide electronic keys with an emergency insert constituted by a conventional mechanical blade. In case of malfunction of the electronic card, this emergency blade can be used to permit the opening of an opening.

It is already known to slide this emergency insert into the electronic key itself and to render it withdrawable by providing indentations in this key. Thus, it suffices to withdraw the emergency insert from the electronic card to open one's vehicle. Nevertheless, to permit good gripping of the insert by the hand, there are presently provided overmoldings of the portion of this insert adapted to be held by the user such that the latter can easily hold it in the hand and can turn it about its longitudinal axis to effect the opening of a door (for example).

The provision of these overmoldings is difficult and increases the volume of the insert.

This insert is generally made of metal (but not exclusively) and has a narrow width. For certain users, this width is insufficient to be able correctly to apply tortion and to rotate the insert about its longitudinal axis.

The object of the present invention is to use an insert without overmolding (to decrease the cost of manufacture and the size), whilst giving the user a sufficient bearing surface that he can apply torsion permitting rotating the insert about its longitudinal axis.

To this end, the present invention relates to an electronic key for an automotive vehicle, said key being of generally flat parallepipedal shape and comprising:

- a housing for an electronic card, said card being adapted to control electronically a locking/unlocking device on board the vehicle and permitting the locking/unlocking of the openings of the vehicle, and
- an insert compartment housing an emergency insert adapted to lock/unlock mechanically the openings of a vehicle in the case of malfunction of the electronic card, said electronic key being characterized in that the insert is constituted solely of a key blade and is provided with recesses suitable to coact with retaining means provided in the insert compartment firmly to hold the insert in the compartment no matter what its position.

Preferably, the insert compartment is provided in or on the edge of the electronic housing such that the electronic housing constitutes a bearing surface for the fingers of a user adapted to permit the application of torsion to the insert so as easily to rotate it about its longitudinal axis when the insert is in active position.

There is thus provided a simple means for rotating the insert which does not increase the size of the latter and which does not require the provision of overmolding, by cleverly using the electronic key itself to rotate the insert.

BRIEF DESCRIPTION OF THE DRAWINGS

Other objects, characteristics and advantages of the resent invention will become further apparent from the description which follows, by way of non-limiting example, with reference to the accompanying drawings, in which.

DESCRIPTION OF THE PREFERRED EMBODIMENTS

Figure 1:
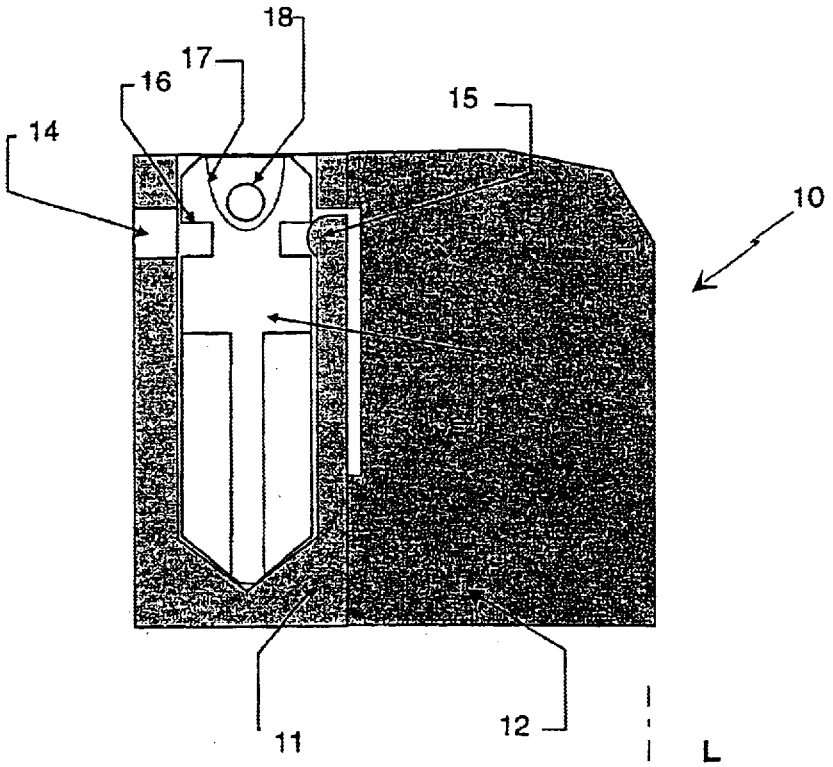
FIG. 1 is a schematic partial cross-sectional view of an electronic key according to the present invention, showing an insert in the rest position and, FIG. 2 is a view similar to FIG. 1 showing the insert in the active position.
Figure 2:
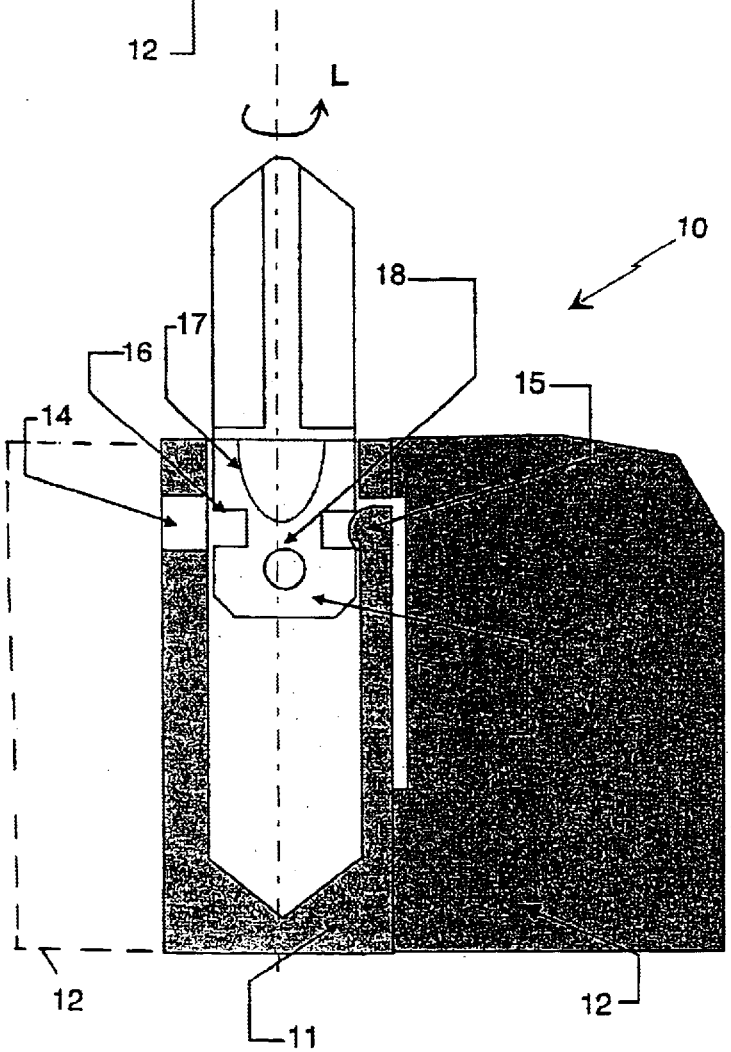

According to the embodiment shown in FIGS. 1 and 2, an electronic key 10 according to the present invention is generally in the form of a flat and rectangular parallelepiped (bank card format for example).

The electronic key comprises:

- a housing 12 for an electronic card, said card being adapted to control electronically a device (not shown) for locking/unlocking on board the vehicle in the case of malfunction of the electronic card, and
- an insert compartment 11 housing an emergency insert 13 adapted to lock/unlock mechanically the openings of a vehicle in case of malfunction of the electronic card, In the rest position, the insert 13 is disposed within its housing 11 and does not extend beyond the electronic key 10 (FIG. 1). When the electronic card operates correctly, and it is not necessary to use the insert, the latter is disposed in its rest position.

Recesses 16 are provided in a conventional manner on the insert 13 and are adapted to coact with retaining means 15 provided on the compartment 11. The coaction of these two elements permits holding firmly the insert within the compartment 11.

When the user needs to use the insert 13, he grips the latter by the gripping region 18. This region always remains accessible because indentations 17 are provided in the electronic card for this purpose. To facilitate extraction of the insert, the user can also act on the latter through the lateral recess 14.

Once it has left the electronic key, the insert can be directly used by placing it in a lock or by exerting on its gripping region 18 a torsion such as to rotate it about its longitudinal axis L (FIG. 2). However, the gripping region 18 being of small width, it can be difficult thus to rotate the insert.

In this case, the user inserts the blade 13 into the compartment 11 by reversing this blade 180°. The same retaining means 15 coact then with the same recesses 16 to ensure the firm holding of the gripping zone 18 of the insert in the compartment 11. To be more precise, in the active position, the recess 16 used is that which is located opposite that used in the rest position because the blade (insert) has been turned by 180°.

Preferably, this permits taking advantage of the provision of the two recesses 16 which conventionally are provided symmetrically on opposite sides of the insert.

When the insert 13 is thus locked in active position, the user inserts it into the appropriate lock.

Preferably, the provision of the insert compartment on the side of the key (as shown in FIGS. 1 and 2) permits providing for the fingers of the user a bearing zone that is no longer limited only to the width of the insert but is distributed over the whole surface of the key. Thus, the electronic housing constitutes for the user a sufficient bearing surface that he can easily exert on this surface a torsion adapted to rotate the insert about its longitudinal axis L.

As a modification shown by the dashed line in FIG. 2, the insert compartment 11 is provided within the electronic housing such that the latter constitutes a pair of bearing surfaces 12, 12' on opposite sides of the insert compartment, permitting applying a torsion to drive the insert 13 in rotation about its longitudinal axis 11. In this way, the pair of bearing surfaces plays the role of the wings of a wing nut.

Preferably, it will be noted that the insert compartment 11 and the housing 12 of the electronic card are made by molding from a single piece.

Of course, the present invention is not limited to the embodiment described and includes all modifications within the scope of one skilled in the art. Particularly, the holding means for the insert in the compartment 11 can be resiliently deformable or not.

What is claimed is:

1. Electronic key (10) for an automotive vehicle, said key being of generally flat parallelepipedal shape and comprising:

a housing (12) for an electronic card, said card being adapted to control electronically a locking/unlocking device onboard the vehicle and permitting the locking/unlocking of the openings of the vehicle, and an insert compartment (11) housing an emergency insert (13) adapted to lock/unlock mechanically the openings of a vehicle in case of malfunction of the electronic card, wherein the insert (13) is constituted solely of a key blade and is provided with recesses (16) adapted to coact with retaining means (15) provided in the insert compartment to hold firmly the insert (13) both in a rest position when the insert is disposed in its housing and in an active position when the blade is turned 180° to be able to be inserted in a suitable lock.

2. Key according to claim 1, wherein the insert compartment (11) is provided with indentations (17) adapted to facilitate withdrawal of the insert from its compartment.

3. Key according to claim 1, wherein the insert compartment (11) and the housing (12) of the electronic card are made by molding in a single piece.

4. Key according to claim 1, wherein the insert compartment (11) is positioned along one of the sides of the key such that when the insert is in active position, the electronic housing (12) constitutes a bearing surface for the fingers of a user permitting application of a torque to rotate the insert about a longitudinal axis (L).

5. Key according to claim 1, wherein the insert compartment (11) is disposed within the electronic housing (12) such that the electronic housing constitutes a pair of bearing surfaces on opposite sides of the insert compartment, permitting application of a torque to rotate the insert about a longitudinal axis (L).

6. An electronic key, comprising:

a housing for an electronic device that operates a vehicle lock;

an insert that is a key blade with longitudinally extended side edges, each of said side edges having a recess therein, said insert having a first longitudinal end for operating a vehicle lock and a second longitudinal end opposite said first longitudinal end;

an insert compartment that receives said insert, said insert compartment being attached to said housing so that the electronic key is a generally flat parallelepiped, said insert compartment receiving an entirety of said insert when said first longitudinal end of said insert is inserted to a bottom of said insert compartment; and a flexible retaining arm that is longitudinally extended in said insert compartment adjacent to one of said side edges of said insert when said insert is received in said insert compartment, said flexible retaining arm having a protrusion that is in one said recess when said first longitudinal end of said insert is inserted to the bottom of said insert compartment and in one said recess when said second longitudinal end of said insert is inserted into said insert compartment and said first longitudinal end is outside said insert compartment.

7. The electronic key of claim 1, wherein the insert compartment is a slot that receives substantially all of the insert when the insert is in the rest position and from which the insert is removable only by sliding the insert in a longitudinal direction.

* * * * *